US011649811B2

(12) United States Patent
Seok et al.

(10) Patent No.: US 11,649,811 B2
(45) Date of Patent: May 16, 2023

(54) VARIABLE CAPACITY SWASH PLATE TYPE COMPRESSOR

(71) Applicant: ESTRA AUTOMOTIVE SYSTEMS CO., LTD., Daegu (KR)

(72) Inventors: Jae Bin Seok, Daegu (KR); Young Ho Bae, Daegu (KR); Sung Hoon Ryu, Daegu (KR); Jae Hoon Seo, Daegu (KR)

(73) Assignee: ESTRA AUTOMOTIVE SYSTEMS CO., LTD., Daegu (KR)

( * ) Notice: Subject to any disclaimer, the term of this patent is extended or adjusted under 35 U.S.C. 154(b) by 4 days.

(21) Appl. No.: 16/768,950

(22) PCT Filed: Sep. 14, 2018

(86) PCT No.: PCT/KR2018/010843

§ 371 (c)(1),
(2) Date: Jun. 2, 2020

(87) PCT Pub. No.: WO2019/112153

PCT Pub. Date: Jun. 13, 2019

(65) Prior Publication Data

US 2021/0222683 A1 Jul. 22, 2021

(30) Foreign Application Priority Data

Dec. 8, 2017 (KR) ..... 10-2017-0168265

(51) Int. Cl.
*F04B 27/12* (2006.01)
*F04B 27/18* (2006.01)
(Continued)

(52) U.S. Cl.
CPC ..... *F04B 27/18* (2013.01); *F04B 27/1072* (2013.01); *F04B 27/12* (2013.01); *F04B 53/006* (2013.01)

(58) Field of Classification Search
CPC ..... F04B 27/18; F04B 27/12; F04B 53/006; F04B 27/1072; F16C 21/00
(Continued)

(56) References Cited

U.S. PATENT DOCUMENTS 5,387,091 A * 2/1995 Kawaguchi ..... F04B 27/1804 417/222.2
2005/0186086 A1* 8/2005 Ota ..... F04B 27/1072 417/269
(Continued)

FOREIGN PATENT DOCUMENTS

CN 1072314 C 10/2001
EP 1 568 885 A2 8/2005
(Continued)

OTHER PUBLICATIONS

Machine Translation of JP 2001289159 A to Ishida, Yoshiyuki published Oct. 19, 2001 (Year: 2001).*
(Continued)

*Primary Examiner* — Philip E Stimpert
*Assistant Examiner* — Dnyanesh G Kasture
(74) *Attorney, Agent, or Firm* — Sughrue Mion, PLLC

(57) ABSTRACT

A variable capacity swash plate type compressor includes: a cylinder block forming a plurality of cylinder bores; a first housing connected to the cylinder block and forming a crank chamber; a second housing; a drive shaft; a rotor mounted on the drive shaft to rotate with the drive shaft; a swash plate connected to the rotor by a hinge mechanism to rotate together with the rotor; and a plurality of pistons that are respectively disposed in the plurality of the cylinder bores and are connected the swash plate to undergo a linear reciprocating motion by a rotational motion of the swash plate. The hinge mechanism includes: a guide groove provided in the rotor; a connecting arm connected to the swash plate and having a cylindrical receiving space; and a cylindrical guide roller that is disposed in the receiving space in a state of being arranged in the guide groove.

2 Claims, 6 Drawing Sheets

(51) Int. Cl.
*F04B 53/00* (2006.01)
*F04B 27/10* (2006.01)

(58) Field of Classification Search
USPC ..... 417/269–271
See application file for complete search history.

(56) References Cited

U.S. PATENT DOCUMENTS

| | | | | |
|---|---|---|---|---|
| 2008/0028927 | A1* | 2/2008 | Lee | F04B 27/1072 92/71 |
| 2017/0145997 | A1* | 5/2017 | Ogawa | F04B 27/0878 |

FOREIGN PATENT DOCUMENTS

| | | | | |
|---|---|---|---|---|
| JP | 2001289159 | A | * 10/2001 | F04B 27/08 |
| JP | 3422186 | B2 | 6/2003 | |
| KR | 10-0282042 | B1 | 2/2001 | |
| KR | 10-0318772 | B1 | 12/2001 | |
| KR | 10-0462433 | B1 | 12/2004 | |
| KR | 10-2009-0040131 | A | 4/2009 | |
| KR | 10-2009-0052919 | A | 5/2009 | |

OTHER PUBLICATIONS

International Search Report for PCT/KR2018/010843 dated Dec. 19, 2018 (PCT/ISA/210).

* cited by examiner

【FIG. 1】
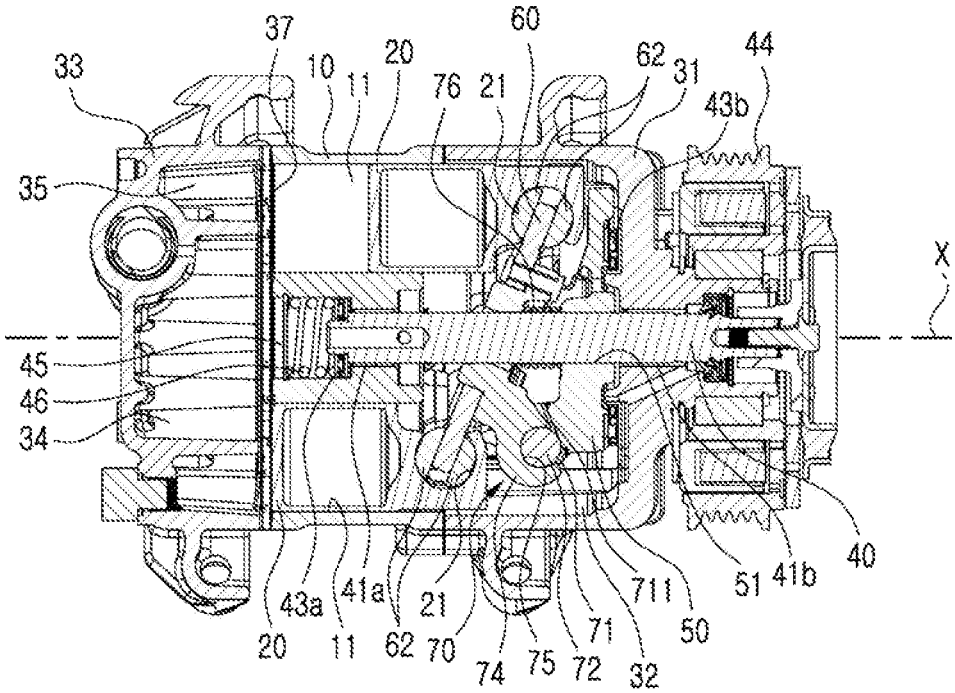

【FIG. 2】
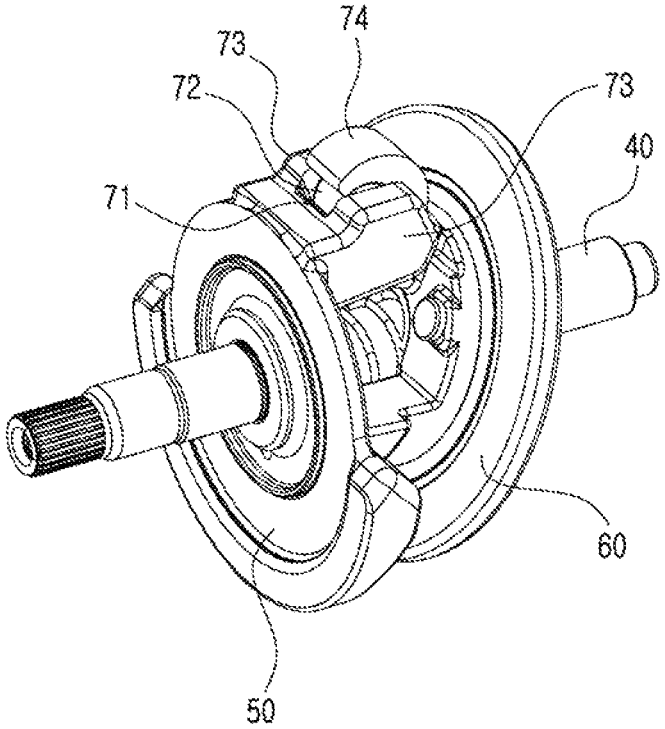

【FIG. 3】
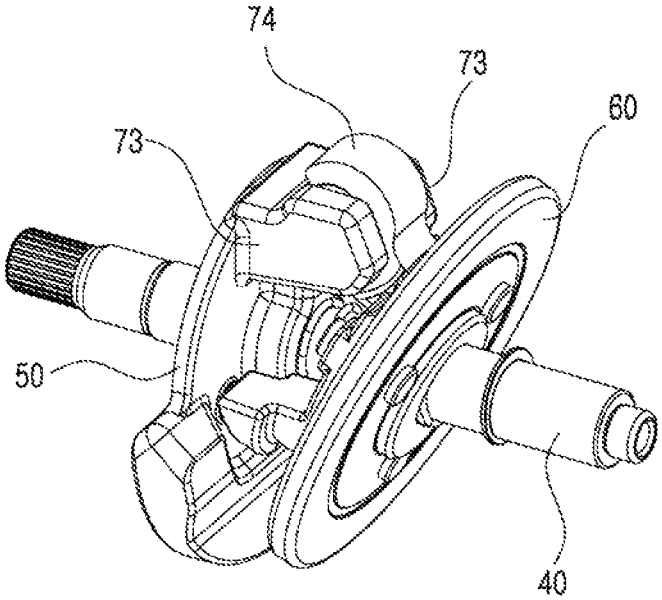

【FIG. 4】
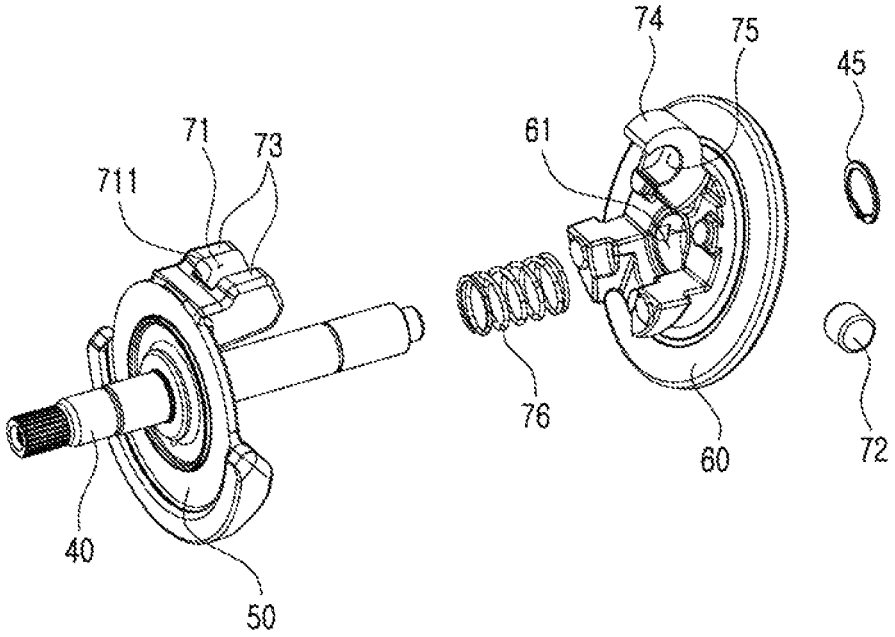

【FIG. 5】
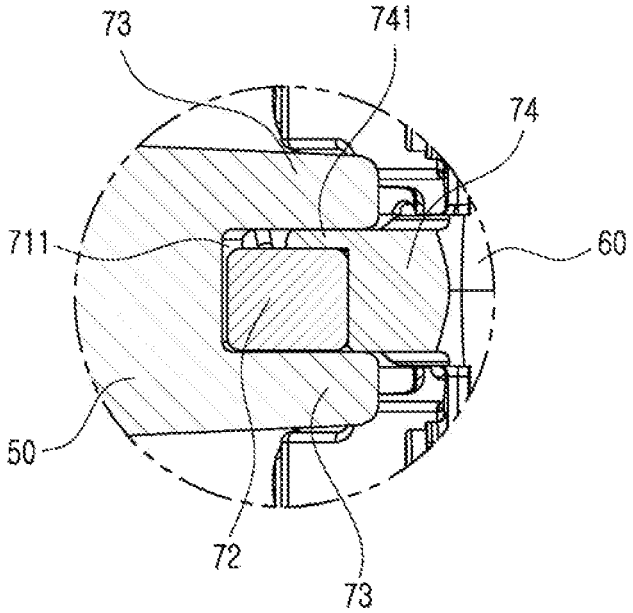

【FIG. 6】
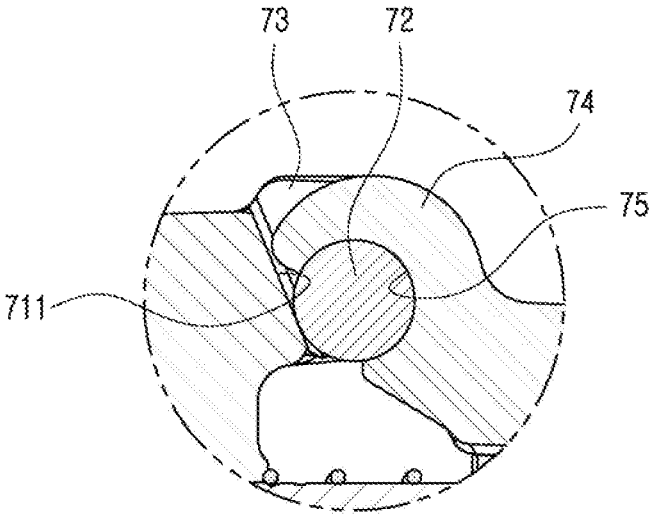

VARIABLE CAPACITY SWASH PLATE TYPE COMPRESSOR

CROSS REFERENCE TO RELATED APPLICATIONS

This application is a National Stage of International Application No. PCT/KR2018/010843 filed Sep. 14, 2018, claiming priority based on Korean Patent Application No. 10-2017-0168265 filed Dec. 8, 2017.

TECHNICAL FIELD

The present invention relates to a variable capacity swash plate type compressor used in an air conditioning apparatus of a vehicle.

BACKGROUND ART

A variable capacity swash plate type compressor used in an air conditioning apparatus of a vehicle includes a drive shaft, and a rotor and a swash plate mounted on the drive shaft to rotate therewith.

The rotor rotates with the drive shaft, and the swash plate is connected to the rotating body via a hinge mechanism. The hinge mechanism connects the swash plate to the rotor so that the swash plate rotates together with the rotor in a pivotable state. At this time, the swash plate allows a compressor capacity to be varied while an inclination angle thereof changes in accordance with a pressure difference between a pressure of a crankcase and a suction pressure.

The swash plate is connected to the piston via a hemispherical shoe, and thereby a rotational motion of the swash plate is converted to a reciprocating motion of a piston. The refrigerant is sucked, compressed and discharged by the reciprocating motion of the piston.

In such a variable capacity swash plate type compressor, various structures of the hinge mechanism for connecting the rotator and the swash plate are known. In particular, Korean patent registration No. 10-0282042 and No. 10-0318772 disclose a hinge mechanism using a cross pin connecting a rotator and a swash plate. However, in such a hinge mechanism, since a slot-shaped groove for guiding the movement of the cross pin must be fabricated, there are problems in that a precise forming is required and an overall structure is complicated.

DETAILED DESCRIPTION OF THE INVENTION

Technical Problem

The present invention has been devised to solve the above problems, and an object of the present invention is to provide a hinge mechanism of a variable capacity swash plate type compressor having a simple structure and easy manufacturing.

Technical Solution

A variable capacity swash plate type compressor according to an exemplary embodiment of the present invention includes: a cylinder block forming a plurality of cylinder bores; a first housing connected to the cylinder block and forming a crank chamber; a second housing connected to the cylinder block and forming a suction chamber and a discharge chamber; a drive shaft rotatably supported by the first housing; a rotor mounted on the drive shaft to rotate with the drive shaft in a state of being disposed in the crank chamber; a swash plate connected to the rotor by a hinge mechanism to rotate together with the rotor in a state of being disposed in the crank chamber; and a plurality of pistons that are respectively disposed in the plurality of the cylinder bores and are connected the swash plate to undergo a linear reciprocating motion by a rotational motion of the swash plate. The hinge mechanism includes: a guide groove provided in the rotor; a connecting arm connected to the swash plate and having a cylindrical receiving space; and a cylindrical guide roller that is disposed in the receiving space in a state of being arranged in the guide groove.

The guide groove may be formed between a pair of supporting arms facing each other that are provided in the rotor.

The connecting arm may be provided with a supporting wall that supports one side of the cylindrical guide roller, and the cylindrical guide roller may be disposed between the supporting wall and one of the pair of the supporting arms.

A bottom surface forming the guide groove may be formed to be inclined at a predetermined angle relative to a direction perpendicular to a longitudinal axis of the drive shaft.

A variable capacity swash plate type compressor according to another exemplary embodiment of the present invention includes: a cylinder block forming a plurality of cylinder bores; a first housing connected to the cylinder block and forming a crank chamber; a second housing connected to the cylinder block and forming a suction chamber and a discharge chamber; a drive shaft rotatably supported by the first housing; a rotor mounted on the drive shaft to rotate with the drive shaft in a state of being disposed in the crank chamber; a swash plate connected to the rotor by a hinge mechanism to rotate together with the rotor in a state of being disposed in the crank chamber; and a plurality of pistons that are respectively disposed in the plurality of the cylinder bores and are connected the swash plate to undergo a linear reciprocating motion by a rotational motion of the swash plate. The hinge mechanism is configured to allow a hinge motion of the swash plate by a combination of a guide groove provided in the rotor and a cylindrical guide roller provided in the swash plate.

The swash plate may include a connecting arm having a cylindrical receiving space, and the guide roller may be disposed in the receiving space.

Effects of the Invention

According to the present invention, a hinge structure for a behavior of a swash plate can be implemented through a simple structure by a combination of a guide groove provided on a rotator and a cylindrical guide roller provided on a swash plate.

BRIEF DESCRIPTION OF THE DRAWINGS

FIG. 1 is a longitudinal sectional view of a variable capacity swash plate type compressor according to an embodiment of the present invention.

FIG. 2 is a perspective view of a hinge structure according to an embodiment of the present invention.

FIG. 3 is a perspective view seen from another direction of a hinge structure according to an embodiment of the present invention.

FIG. 4 is an exploded perspective view of a hinge structure according to an embodiment of the present invention.

FIG. 5 is a cross-sectional view of a hinge structure according to an embodiment of the present invention.

FIG. 6 is a longitudinal sectional view of a hinge structure according to an embodiment of the present invention.

DETAILED DESCRIPTION OF THE EMBODIMENT

Hereinafter, exemplary embodiments of the present invention will be described in detail with reference to the accompanying drawings.

Referring to FIG. 1, a cylinder block 10 forms a plurality of cylinder bores 11. The cylinder bore 11 is extend in a direction parallel to a longitudinal axis X of a variable capacity swash plate type compressor, and for example six cylinder bores 11 may be arranged along a circumferential direction at equal intervals.

A plurality of pistons 20 are linearly reciprocally movable in the respective cylinder bore 11. Refrigerant is introduced, compressed and discharged by the linear reciprocating movement of the piston 20.

A first housing 31 and a second housing 33 are respectively connected to both sides of the cylinder block 10. For example, the first housing 31 may be connected to one side of the cylinder block 10 to form an airtight crank chamber 32, and the second housing 33 may be connected to the other side of the cylinder block 10 to form a suction chamber 34 and a discharge chamber 35. At this time, the first housing 31, the cylinder block 10 and the second housing 33 may be fastened to each other by a through bolt.

A valve plate 37 forming a refrigerant movement passage for the movement of the refrigerant may be interposed between the second housing 33 and the cylinder block 10.

A drive shaft 40 is rotatably supported onto the first housing 31. The drive shaft 40 may be disposed to extend through the first housing 31 to the cylinder block 10. The drive shaft 40 may be connected to a drive pulley 44 to rotate together with the drive pulley 44.

A rotor 50 is mounted to the drive shaft 40 to rotate with the drive shaft 40 in a state of being disposed in the crank chamber 32. For example, as shown in FIG. 1, a rotor 50 and the drive shaft 40 may be fastened to each other in a state in which the drive shaft 40 passes through a through hole 51 formed in the center of the rotor 50.

A swash plate 60 is connected to the rotor 50 via a hinge mechanism 70 to rotate together with the rotor 50. At this time, as shown in FIG. 1, the rotor 50 may be disposed at an end portion of the crank chamber 32 of the first housing 31, and the swash plate 60 may be disposed in the crank chamber 32 to be located between the rotor 50 and the cylinder block 10. In this case, the drive shaft 40 may be supported by radial bearings 41*a* and 41*b* in a radial direction, and the rotor 50 mounted onto the drive shaft 40 may be supported in the longitudinal direction by thrust bearings 43*a* and 43*b*. Specifically, one end of the drive shaft 40 may be supported by a radial bearing 41 supported by a coil spring 46 supported by a snap ring 45 that is installed in a fixed portion in the cylinder block 10.

The swash plate 60 has a through hole 61 in the central portion thereof, and the drive shaft 40 is inserted into the through hole 61. At this time, the through hole 61 is formed to have a convex surface, the inclination angle of the swash plate 60 with respect to the drive shaft 40 may be changed. As shown in FIG. 1 and FIG. 4, a variable control spring 76 for variable control of the inclination angle of the swash plate 60 may be provided, and the variable control spring 76 operates so that a change from a maximum angle variation to a minimum angle variation can be easily made. The inclination angle of the swash plate 60 is changed by the rotation of the swash plate with respect to the drive shaft 40, and the capacity of the compressor is varied depending on the change of the inclination angle that is caused by a pressure difference between the pressure in the crank chamber 32 and the pressure of the sucked refrigerant and the action of the variable control spring 76.

The swash plate 60 is connected to the piston 20 so as to cause the piston 20 to undergo a reciprocating linear motion by its rotational motion, and for example, as shown in FIG. 1, the swash plate 60 may be connected to the piston 20 via a hemisphere-shaped shoe 61. Specifically, as shown in FIG. 1, an end portion of the swash plate 60 may be disposed between a pair of hemispherical shoes 61 disposed in a shoe pocket of a spherical shape that is formed on the piston 20. At this time, the shoe pocket 21 may have a spherical shape so as to allow slipping between the shoe 61 and the shoe pocket 21. With this structure, the swash plate 60 can be rotated relative to the piston 20, and thereby the rotational motion of the swash plate 60 can be converted into a linear reciprocating motion of the piston 20.

The hinge mechanism 70 functions to connect the swash plate 60 and the drive shaft 40 such that the swash plate 60 can be hinged with respect to the drive shaft 40, that is, can be pivoted, and the swash plate 60 rotates together with the drive shaft 40. Hereinafter, a hinge mechanism according to an embodiment of the present invention will be described in detail with reference to the accompanying drawings.

The hinge mechanism 70 is configured to allow the hinge motion of the swash plate 60 relative to the rotor 50 by a combination of a guide groove 71 provided in the rotor 50 and a cylindrical guide roller 72 provided in the swash plate 60.

Specifically, referring to FIG. 1 and FIG. 4, the guide groove 71 may be formed on a surface of the rotor 50 facing the swash plate 60. A bottom surface 711 forming the guide groove 71 may be formed as an inclined surface inclined by a predetermined angle with respect to a direction perpendicular to the longitudinal axis X of the drive shaft 40. At this time, a pair of guide arms 73 facing each other that are formed by protruding from the surface of the rotor 50 facing the swash plate 60 are provided, and the guide groove 71 may be formed between a pair of the guide arms 73.

The guide roller 72 may be disposed in a cylindrical receiving space 75 provided in a connecting arm 74 that is formed integrally with the swash plate 60. At this time, the guide roller 72 may be assembled in a cylindrical receiving space 75 in a press-fit or slide-fit manner. Referring to FIG. 4, the connecting arm 74 has a supporting wall 741 that is configured to support one side of the guide roller 72. At this time, referring to FIG. 5 and FIG. 6, both sides of the guide roller 72 are disposed between the supporting wall 741 and one of the pair of guide arms 73. At this time, the other surface of the supporting wall 741 is in close contact with the other of the pair of guide arms 73. Further, a cylindrical outer surface of the guide roller 72 having a cylindrical shape is disposed in contact with the surface forming the receiving space 75 and the bottom surface 711 forming the guide groove 71, respectively. In this state, when the inclination angle of the swash plate 60 is changed, the guide roller 72 moves on the bottom surface 711.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

INDUSTRIAL APPLICABILITY

The present invention relates to a swash plate type compressor and can be applied to an air conditioner of a vehicle so as to have an industrial applicability.

The invention claimed is:

1. A variable capacity swash plate type compressor comprising:

a cylinder block forming a plurality of cylinder bores;

a first housing connected to the cylinder block and forming a crank chamber;

a second housing connected to the cylinder block and forming a suction chamber and a discharge chamber;

a drive shaft rotatably supported by the first housing;

a rotor mounted on the drive shaft to rotate with the drive shaft in a state of being disposed in the crank chamber;

a swash plate connected to the rotor by a hinge mechanism to rotate together with the rotor in a state of being disposed in the crank chamber; and a plurality of pistons that are respectively disposed in the plurality of the cylinder bores and are connected to the swash plate to undergo a linear reciprocating motion by a rotational motion of the swash plate, wherein the hinge mechanism comprises:

a guide groove that is formed between a pair of guide arms provided in the rotor to face each other;

a connecting arm connected to the swash plate and having a cylindrical receiving space; and a cylindrical guide roller that is disposed in the cylindrical receiving space in a state of being arranged in the guide groove, wherein a curved surface of the connecting arm forming the cylindrical receiving space that supports a curved surface of the cylindrical guide roller toward a bottom surface of the guide groove is formed by a single curved surface along a longitudinal direction of the guide roller, wherein the cylindrical guide roller is configured to roll on the bottom surface of the guide groove in a state such that a movement in a longitudinal direction is restricted by one of the pair of the guide arms in response to a rotation of the swash plate, wherein the connecting arm is provided with a supporting wall that is disposed between the other one of the pair of the guide arms and the cylindrical guide roller to support one side of the cylindrical guide roller, and wherein the cylindrical guide roller is disposed between the supporting wall and the one of the pair of the guide arms, one longitudinal side of the cylindrical guide roller being supported by the one of the pair of the guide arms, and another longitudinal side of the cylindrical guide roller being supported by the supporting wall.

2. The variable capacity swash plate type compressor of claim 1, wherein a bottom surface forming the guide groove is formed to be inclined at a predetermined angle relative to a direction perpendicular to a longitudinal axis of the drive shaft.

* * * * *